US006719033B2

(12) United States Patent
Stoltenberg

(10) Patent No.: US 6,719,033 B2
(45) Date of Patent: Apr. 13, 2004

(54) POWER OPERATED MULTI-PANELED GARAGE DOOR OPENING SYSTEM

(75) Inventor: Karl Stoltenberg, 3900 Skyview Rd., Minnetonka, MN (US) 55345

(73) Assignee: Karl Stoltenberg, St. Louis Park, MN (US)

( * ) Notice: Subject to any disclaimer, the term of this patent is extended or adjusted under 35 U.S.C. 154(b) by 0 days.

(21) Appl. No.: 10/155,583

(22) Filed: May 24, 2002

(65) Prior Publication Data

US 2003/0217820 A1 Nov. 27, 2003

(51) Int. Cl.[7] ..... E05F 11/00

(52) U.S. Cl. ..... 160/188; 160/133; 160/189; 160/310; 49/199

(58) Field of Search ..... 160/133, 188, 160/189, 201, 200, 209, 310; 49/199, 200, 197

(56) References Cited

U.S. PATENT DOCUMENTS

| | | | | | |
|---|---|---|---|---|---|
| 3,839,827 | A | * | 10/1974 | Dickinson | 49/197 |
| 3,981,343 | A | * | 9/1976 | Devito | 160/190 X |
| 4,368,770 | A | * | 1/1983 | Ulfhielm | 160/84 |
| 4,484,613 | A | * | 11/1984 | Timoschuk | 160/193 |
| 5,572,829 | A | * | 11/1996 | Stoltenberg | 49/200 |
| 6,082,433 | A | * | 7/2000 | Vafaie et al. | 160/310 |
| 6,089,304 | A | * | 7/2000 | Mullet et al. | 160/209 |
| 6,442,897 | B1 | * | 9/2002 | Mullet | 49/199 |

FOREIGN PATENT DOCUMENTS

| | | | | |
|---|---|---|---|---|
| DE | 4024666 | * | 12/1991 | 160/188 X |
| JP | 4151373 | * | 6/1994 | 160/188 X |
| WO | WO 02/01033 | * | 1/2002 | 160/188 X |

* cited by examiner

*Primary Examiner*—Bruce A. Lev
(74) *Attorney, Agent, or Firm*—Jeffrey R. Stone; Briggs and Morgan, P.A.

(57) ABSTRACT

The present invention discloses the novel placement of two pairs of vertical track disposed adjacent to each other together with a pair of radiused horizontal tracks being attached to the outer pair of vertical tracks allowing the use of a flexible lift and reverse cable system to open, close and reverse multi-paneled garage doors. Use of an inner and outer pair of vertical tracks disposed adjacent to each other allows the lowermost rollers to be guided on the inner vertical tracks and the remaining rollers to be guided on the outer vertical tracks and, ultimately, the horizontal tracks as the garage door opens. This configuration allows the lift cable a clear pathway to travel from the drum down the center of the inner vertical tracks to the connection with the shaft journal mounted near the bottom of the garage door. The reverse cable also has a free pathway from its connection to the shaft journal at the lower portion of the garage door, down around the pulley located adjacent to the bottom of the garage door and then upwardly toward the back side of the cable drum and, ultimately, connection with the lift cable to form a continuous loop without interfering with the rollers. This configuration ensures that the lift and reverse cables move simultaneously, thus maintaining the constant tension in the continuous loop of cable necessary to provide the required safety feedback mechanism case an obstruction is encountered during the closing operation.

17 Claims, 3 Drawing Sheets

POWER OPERATED MULTI-PANELED GARAGE DOOR OPENING SYSTEM

FIELD OF THE INVENTION

This invention relates generally to power operated garage doors and specifically to a garage door opening system that complies with residential safety guidelines for use with a door that has multiple panels or sections.

BACKGROUND OF THE PRESENT INVENTION

Currently, power operated one-piece garage door opening systems use a dual lift and reverse cable system in conjunction with a jack shaft garage door opener. Such systems, however, do not work with multi-panel or sectional garage doors. The existing mechanisms for moving a one piece door between a vertical closed position and a horizontal open position consist of a pair of vertical guide tracks and a pair of radiused horizontal guide tracks with a pair of guides or rollers on the door engaging the vertical tracks and another pair of guides or rollers engaging the horizontal tracks. The known system includes two separate segments of flexible cable, a lifting segment and a reverse segment, each being attached to the lower guide or roller on the door. The reverse section then travels down around a floor-mounted pulley and then up to a drum that is mounted above the vertical tracks on a jack shaft, commonly known as a torsion bar, that is mounted above the door. The lifting segment travels up from the lower guide and wraps around the drum. The torsion bar is connected to a reversible motorized drive means. As the motorized drive begins to turn the torsion bar, the lift portion of the flexible cable pulls the door upwardly and open, causing the lift portion of the cable to wind around the drum mounted on the torsion bar and the reverse portion of the cable simultaneously to unwind from the drum. Closing the door involves reversing the rotation of the torsion bar causing the lift cable to unwind from the drum while the reverse cable is rewound.

This dual cable system does not work with a multi-panel, sectional door, which is the most common embodiment for residential application. Residential applications must meet strict federal consumer protection agency guidelines that are tested for by Underwriters Laboratory, including inherent reversing requirements if the door encounters an obstruction while closing. In order to meet these requirements, the lift cable and the reverse cable must wind and unwind off the drum at the same rate so that if an obstruction is encountered, the force is instantly transmitted to the motor via the reverse cable and the closing motion of the door is immediately stopped and reversed. Thus, the lift and the reverse cables must be attached at the same point, near the axis of lift at the bottom of the door, in a known embodiment, the cable attachment point is at the same point as the roller near the bottom of the door. Implementation of this known system on a multi-panel, sectioned door will, however, result in the cables interfering with the rollers and binding the movement of the door. The present invention solves this problem.

SUMMARY OF THE INVENTION

A principal object and advantage of the present invention is to provide a mechanism for opening and closing a garage door with a plurality of panels or sections with a flexible cabling system that is powered by a reversible motorized jack shaft operating system. Such a system is known in the art for one-piece garage doors, however no equivalent commercial application is known for multi-panel garage doors.

The present invention discloses the novel placement of two pairs of vertical track disposed adjacent to each other together with a pair of radiused horizontal tracks being attached to the outer pair of vertical tracks. Use of an inner and outer pair of vertical tracks disposed adjacent to each other allows the lowermost rollers to be guided on the inner vertical tracks and the remaining rollers to be guided on the outer vertical tracks and, ultimately, the horizontal tracks as the multi-panel, sectional garage door opens. This configuration allows the lift cable a clear pathway to travel from the drum down the center of the inner vertical tracks to the connection with the shaft journal mounted near the bottom of the garage door. The reverse cable also has a free pathway from its connection to the shaft journal at the lower portion of the garage door, down around the pulley located adjacent to the bottom of the garage door and then upwardly toward the back side of the cable drum and, ultimately, to be attached to the drum so that it wraps around the drum as the door closes, or unwraps from the drum as the door opens, without interfering with the rollers. This configuration ensures that the lift and reverse cables move simultaneously, thus maintaining the constant tension in the flexible cabling system necessary to provide the required safety feedback mechanism in case an obstruction is encountered during the closing operation.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1A:
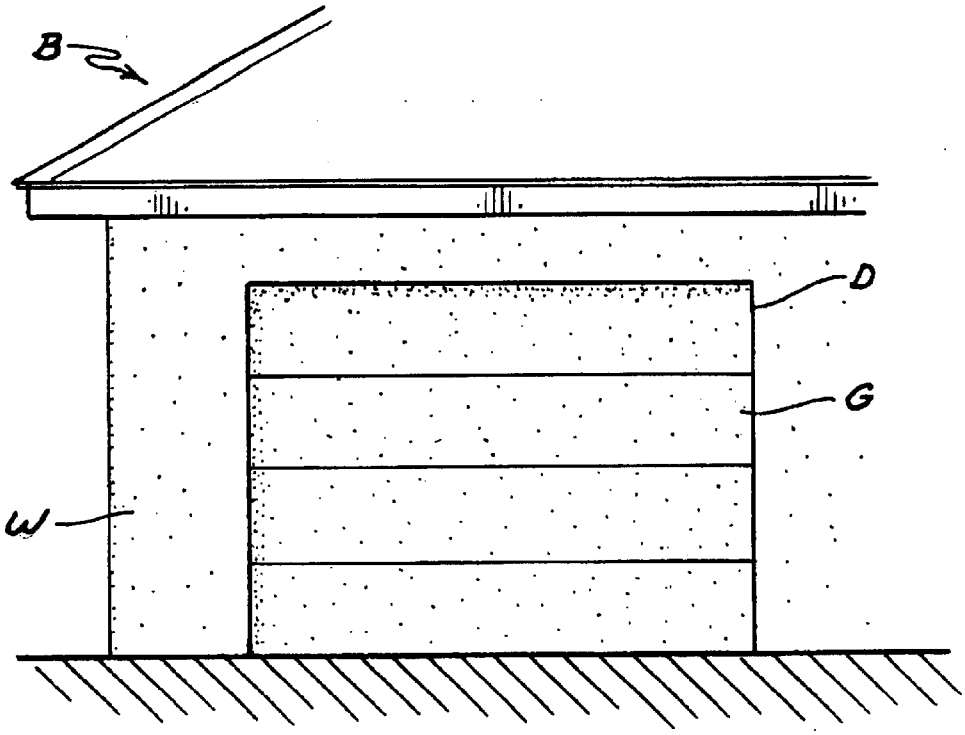
FIG. 1A is a front view of a building having a multi-paneled garage door in the closed position.
Figure 1B:
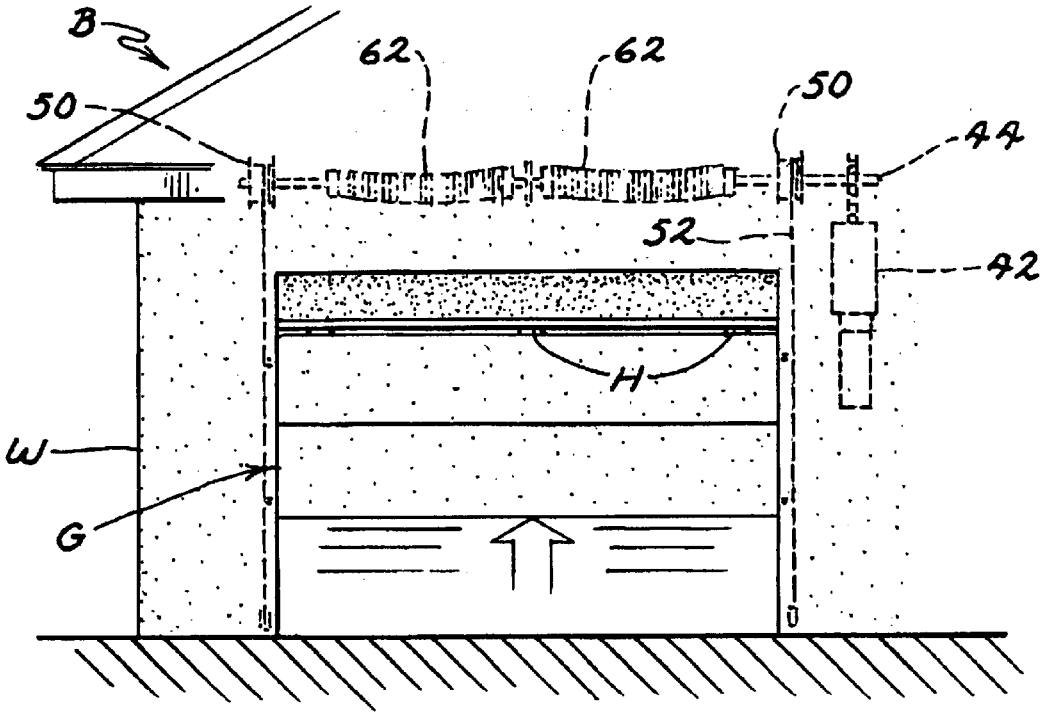
FIG. 1B is a front view of a building having a multi-paneled garage door during the opening operation and showing the drive mechanism in phantom outline.
Figure 2:
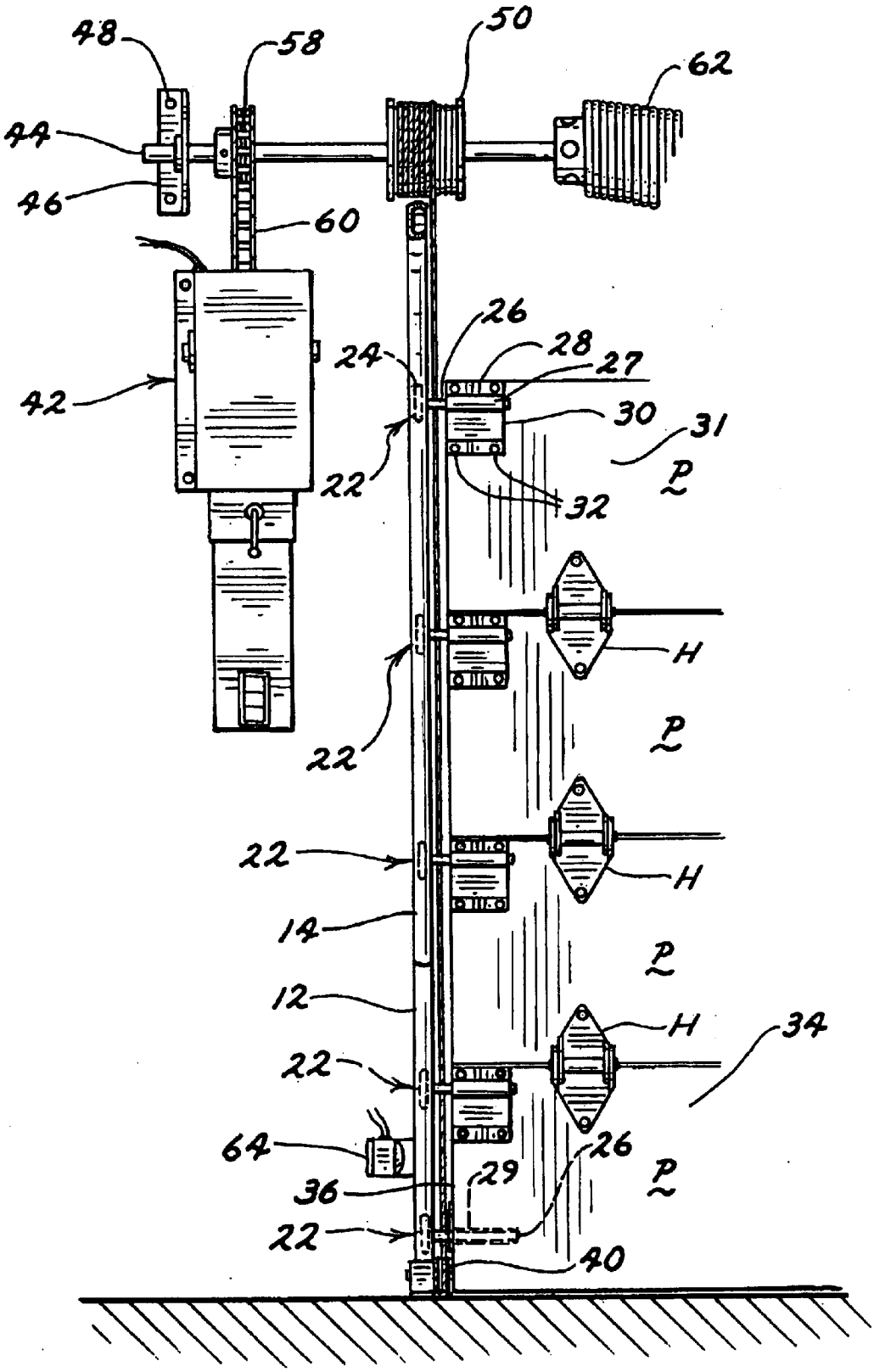
FIG. 2 depicts one side of the garage door opening mechanism from the interior of the garage while the multi-paneled garage door is in the vertical and closed position.
Figure 3A:
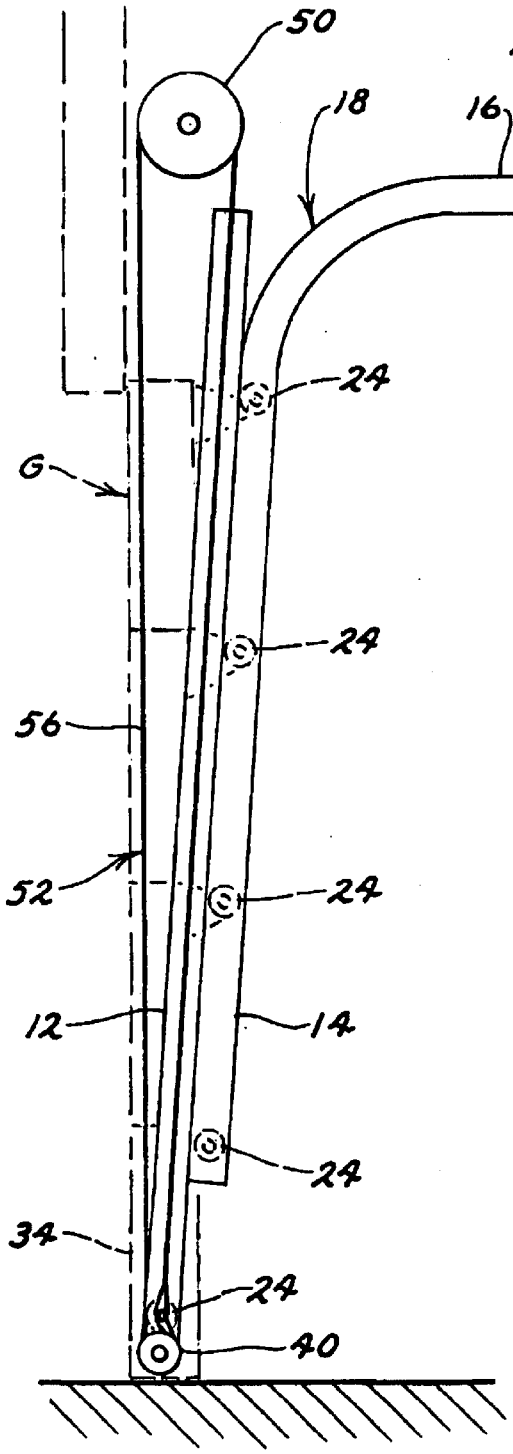
FIG. 3A is a cross section of the garage door opening mechanism with the multi-paneled door in the vertical and closed position.

FIGS. 1A and 1B show a multi-paneled power operated garage door "G". The garage door "G" is composed of a plurality of panels "P" and is mounted in a door opening "D" which is located in a front wall "W" of a building "B". The panels "P" are connected by hinges "H". The garage door "G" is disposed substantially within the door opening "D" and is substantially vertically disposed in the closed position as depicted in FIGS. 1A, 2 and 3A. The garage door "G" is mounted on a support mechanism that allows for guided upward and hinged movement of the door "G" to a raised open position wherein the door "G" is and typically, but not always, disposed substantially horizontally adjacent to the garage ceiling.

Figure 3B:
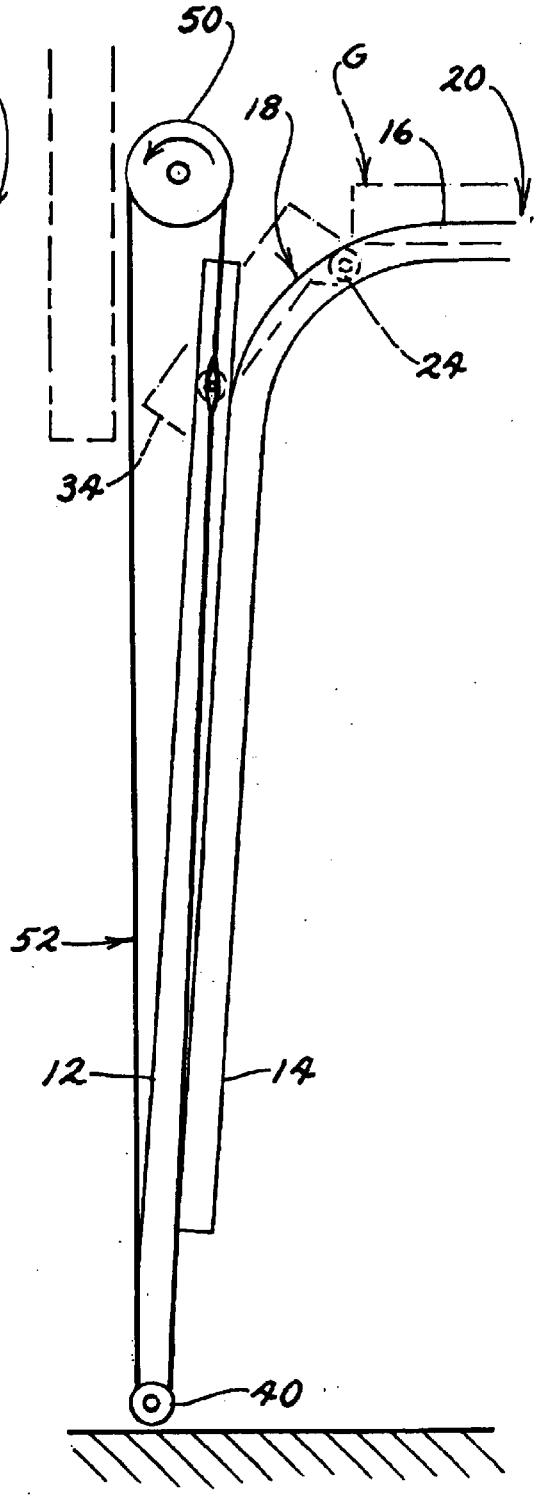
FIG. 3B is a cross section of the garage door opening mechanism with the multi-paneled door in the substantially horizontal and open position.

Referring to FIGS. 3A and 3B, the support and guided movement of the garage door "G" is accomplished by an inner pair of vertical tracks 12 attached adjacent to the sides of the door opening "D". A second pair of outer vertical tracks 14 are mounted adjacent to the inner set of vertical tracks 12. A pair of horizontal tracks 16 are mounted above the garage door "G" and adjacent to the ceiling. The proximal end 18 of the horizontal tracks 16 are radiused downwardly and connected with the outer pair of vertical tracks 14 forming a continuous track. The horizontal tracks 16 terminate at the distal end 20.

As shown in FIG. 2, a pair of guide members 22 are attached to each of the panels "P" of the door "G". The guide members 22 may include rollers 24 or the equivalent. The rollers 24 extend laterally out from the sides of the door "G". The rollers 24 corresponding to the upper panels in the preferred embodiment have shafts 26 that are received by bearings 27 which in the preferred embodiment comprise shaft journals 28 which are in turn attached to extension brackets 30. Each extension bracket 30 is attached to the inner surface 31 of the door "G" with a plurality of screws 32 or the equivalent. The shaft journals 28 corresponding to the upper panels engage the extension brackets 30 and allow engagement of the rollers 24 with the outer vertical section of tracks 14 while the door is in the vertical and closed position and engagement of the horizontal tracks 16 while the door is in the horizontal or open position. The shaft journals 29 corresponding to the lowermost panel 34 are mounted on the sides 36 or the lower inner surface 31 of the garage door "G" near the bottom. This placement allows the rollers 24 to engage the inner vertical section of tracks 12 while the door is either in the vertical and closed position or the horizontal or open position. It is understood that in practice that the lowermost shaft journals 29 could be mounted on the lower inner surface 31 of the door. A pulley 40 is mounted adjacent to the garage floor, adjacent to the bottom of the inner vertical shaft 12, and substantially vertically below the lowermost shaft journal 29. In the preferred embodiment, the inner vertical tracks 12, outer vertical tracks 14, and horizontal tracks 16 are channel shaped in cross section and receive the rollers 24 as illustrated in FIGS. 2, 3A and 3B.

A jack shaft operator 42, or equivalent reversible motorized operating system, is mounted on the wall adjacent to the garage door "G" as shown in FIG. 2. A jack shaft 44, commonly known as a torsion bar, is mounted on the wall horizontally above the garage door "G" with brackets 46 and a plurality of screws 48. A pair of drums 50 are mounted on the torsion bar 44 at a point substantially vertically above the inner vertical tracks 12 and the outer vertical tracks 14. FIGS. 3A and 3B show the flexible cabling systems 52 located on each side of the door that are wound onto the drums 50 and around the pulley 40. In the preferred embodiment, each cable system 52 is comprised of two sections of flexible cable. The lift cable sections 54 are attached to the lowermost shaft journals 29 and bear the load of the door as it is lifted vertically.

As indicated in FIGS. 3A and 3B, the reverse cable sections 56 of the flexible cable system 52 are each fixedly attached to, or in proximity to, the lowermost shaft journals 29 or to the lifting cable 54. Each reverse cable 56 is then wound around a pulley 40 that is fixedly mounted beneath the lowermost shaft journal 29. The reverse cable 56 can be comprised of two segments joined together for ease of installation and operation. The two segments comprising the reverse cable 56 can be of different cable diameters, typically a thicker upper segment that wraps around the drum 50 and a thinner lower segment that is connected to the thicker segment and that tracks around the pulley 40 and is attached to the lowermost shaft journal 29. This configuration allows for ease of tracking around the pulley 40 with a smaller diameter cable. In practice, a single reverse cable 56 may be sufficient to accomplish the safety feedback to the jack shaft operator 42 required by Underwriters Laboratory.

Opening of the door is accomplished by actuating the jack shaft operator 42 which initiates rotation of the torsion bar 44 that is mounted above the door. The jack shaft operator 42 is a reversible motor and is drivingly connected to the torsion bar 44 by means of a chain 60 and sprocket 58 in the typical commercial embodiment. Also mounted on the torsion bar is at least one torsion spring 62 that counterbalances the weight of the door as it is being lifted. Clockwise rotation of the torsion bar 44 causes the lift cables 54 to wind around the drums 50 mounted on the torsion bar 44 and also causes the reverse cable 56 to unwind from the drums 50 and to be pulled up around the floor-mounted pulley 40. The lift cable 54 is disposed along the inner vertical track 12. As the door moves vertically, the rollers 24 attached to the lowermost panel 34 are guided up within the inner vertical tracks 12 and the upper rollers 24 are guided up within the outer vertical tracks 14 and ultimately within the radiused horizontal tracks 16 until the door is substantially horizontal and open.

Closing of the door is accomplished by actuation of the jack shaft operator 42 causing the torsion bar 44 to rotate in the counterclockwise direction. This causes the lift cable 54 to unwind from the drum 50 and the reverse cable 56 to wind back up on the drum 50.

Use of inner and outer pair of vertical tracks in the manner described allows the lift cable 54 a clear pathway to travel from the drum 50 down the center of the inner vertical tracks 12 to the connection with the lowermost shaft journal 29. The reverse cable 56 also has a free pathway from its connection to the lowermost shaft journal 29, down around the pulley 40 and then upwardly toward the cable drum 50. As a result, the two cable sections wind and unwind simultaneously from the drum 50. This allows for immediate transference of the force of any obstructions encountered during the closing operation to the jack shaft operator 42 causing the motor to reverse and open the door. In addition, a motion sensor 64 is provided to detect any motion under the door while closing.

The above specification describes certain preferred embodiments of this invention. This specification is in no way intended to limit the scope of the claims. Other modifications, alterations, or substitutions may now suggest themselves to those skilled in the art, all of which are within the spirit and scope of the present invention. It is therefore intended that the present invention be limited only by the scope of the attached claims below:

What is claimed is:

1. A power operated door opening mechanism for moving multi-panel garage doors that are installed in door openings between an open and a closed position, including a jack shaft operator adapted to be secured to the door opening, a torsion bar adapted to be mounted horizontally above the door opening and rotationally driven by the jack shaft operator and a pair of drums mounted on the torsion bar, the doors having an inner surface, a side surface and panels, including a lowermost panel, said mechanism comprising:

a plurality of bearings, a pair of said bearings adapted to be secured to each door panel, including a pair of lowermost bearings adapted to be secured to the lowest door panel;

a plurality of guide members, said guide members adapted to extend laterally from the side of the door, said guide members rotationally engaging said bearings, including lowermost guide members rotationally engaged said lowermost bearing;

tracks for supporting and guiding said guide members;

a pair of pulleys adapted to be secured adjacent to the bottom of the garage door and substantially vertically beneath said lowermost bearing;

a pair of lift cables having two ends, one end of said lift cables being connectedly attached to said lowermost bearing, the other end being connectedly attached to the drums, said lift cables being wound and unwound from the drums as the jackshaft operator drivingly turns the torsion bar; and at least one reverse cable, one end of said reverse cable being connectedly attached to said lowermost bearing, the other end being connectedly attached to the drum, said reverse cable further engaging said pulleys, said reverse cable being wound and unwound from the drums as the jackshaft operator drivingly turns the torsion bar.

2. The apparatus of claim 1, wherein said reverse cable is comprised of at least two segments of differing diameters, said segments being fixedly attached to each other.

3. The apparatus of claim 1, wherein said tracks further comprise:

a pair of inner vertical tracks having side edges adapted to be disposed adjacent to either side of the door opening; and a pair of outer vertical tracks having an upper end, a lower end, and side edges, said side edge of said outer vertical tracks being disposed adjacent to said side surface of said inner vertical tracks.

4. The apparatus of claim 3 wherein said tracks further comprise a pair of horizontal tracks having a proximal end and a distal end, said horizontal tracks adapted to be positioned above said door opening, said proximal end of said horizontal tracks being radiused downwardly to connect with the upper end of said upper end of said outer vertical tracks.

5. The apparatus of claim 1 wherein said bearings further comprise:

a plurality of substantially cylindrical upper shaft journals, said upper shaft journals rotatably engaging and supporting said guide members, said shaft journals adapted to being further fixedly attached to the inner surface of all panels of the multi-panel door except the lowermost panel; and a pair of lowermost shaft journals, said lowermost shaft journals rotatably engaging and supporting said guide members, said lowermost shaft journals adapted to being attached to the side surface of the lowermost panel of the door.

6. The apparatus of claim 5 wherein said lowermost shaft journals are adapted to be attached to the inner surface of the lowermost panel of the door.

7. The apparatus of claim 5 wherein said guide members further comprise a plurality of upper guide members, said upper guide members being rotatably disposed in said upper shaft journals, said upper shaft journals adapted to being attached to the inner surface of the door, said upper-guide members adapted to be projecting laterally from the side surface of the door, said upper guide members being engaged in said outer vertical tracks when the door is in the closed position and further engaging said horizontal tracks when the door is in the open position.

8. The apparatus of claim 7 further comprising an extension member for extending said upper shaft journals away from the inner surface of the door, said extension member adapted to being rigidly attached to the inner surface of the door and rotatably engaging said upper guide members.

9. The apparatus of claim 5 wherein said guide members further comprise a lowermost guide member adapted to be projecting laterally from the side surface of the door, said lowermost guide member being attached to said lowermost shaft journal, said lowermost guide member engaging said inner vertical tracks.

10. A power operated door opening mechanism for moving multi-panel garage doors that are installed in door openings between an open and a closed position, including a jack shaft operator adapted to be mounted adjacent to the door opening and a torsion bar adapted to be mounted horizontally above the door opening and rotationally driven by the jack shaft operator, the doors having an inner surface and a side surface, said mechanism comprising:

a plurality of bearings, a pair of said bearings adapted to be being fixedly attached to each door panel, including a pair of lowermost bearings adapted to be being attached to the lowest door panel;

a plurality of guide members, said guide members adapted to be extending laterally from the side of the door, said guide members rotationally engaging said bearings, including a pair of lowermost guide members rotationally engaging said lowermost bearing;

a pair of pulleys adapted to be fixedly mounted adjacent to the bottom of the garage door and substantially vertically beneath said lowermost bearing;

a pair of lift cables having two ends, one end of said lift cables being connectedly attached to said lowermost bearing, the other end being connectedly attached to the drum, said lift cables being wound and unwound from the drums as the jackshaft operator drivingly turns the torsion bar;

a pair of reverse cables, one end of said reverse cables being connectedly attached to said lowermost bearing, the other end being connectedly attached to the drum, said reverse cables further engaging said pulleys, said reverse cables being wound and unwound from the drums as the jackshaft operator drivingly turns the torsion bar; and tracks for supporting and guiding said guide members, said tracks further comprising:

a pair of inner vertical tracks having side edges adapted to be disposed adjacent to either side of the door opening;

a pair of outer vertical tracks having an upper end, a lower end, and side edges, said side edge of said outer vertical tracks being disposed adjacent said side edge of said inner vertical tracks; and horizontal tracks having a proximal end and a distal end, said horizontal tracks adapted to be positioned above said door opening, said proximal end of said horizontal tracks being radiused downwardly to connect with the upper end of said upper end of said outer vertical tracks.

11. The apparatus of claim 10, wherein said reverse cable is comprised of at least two segments of differing diameters, said segments being fixedly attached to each other at a point along the reverse cable pathway between the drums and said pulley.

12. The apparatus of claim 10 wherein said bearings further comprise:

a plurality of opposing pairs of substantially cylindrical upper shaft journals, said upper shaft journals rotatably engaging and supporting said guide members, said shaft journals adapted to being further fixedly attached to the inner surface of all panels of the multi-panel door except the lowermost panel; and a pair of lowermost shaft journals, said lowermost shaft journals rotatably engaging and supporting said guide members, said lowermost shaft journals adapted to being attached to the side surface of the lowermost panel of the door.

13. The apparatus of claim 12 wherein said lowermost shaft journals are adapted to be attached to the inner surface of the lowermost panel of the door.

14. The apparatus of claim 12 wherein said guide members further comprise a plurality of upper guide members, said upper guide members being rotatably disposed in said upper shaft journals and projecting laterally from the side surface of the door, said upper guide members being engaged in said outer vertical tracks when the door is in the closed position and further engaging said horizontal tracks when the door is in the open position.

15. The apparatus of claim 14 further comprising an extension member for extending said upper shaft journals away from the inner surface of the door, said extension member adapted to being rigidly attached to the inner surface of the door and rotatably engaging said upper guide members.

16. The apparatus of claim 12 wherein said guide members further comprise a lowermost guide member projecting laterally from the side surface of the door, said lowermost guide member being attached to said lowermost shaft journal, said lowermost guide member engaging said inner vertical tracks.

17. A power operated door opening mechanism for moving multi-panel garage doors that are installed in door openings between an open and a closed position, including a jack shaft operator adapted to be mounted adjacent to the door opening, a torsion bar adapted to be mounted horizontally above the door opening and rotationally driven by the jack shaft operator, and drums mounted on the torsion bar, the doors having an inner surface and a side surface, said mechanism comprising:

a plurality of opposing substantially cylindrical upper shaft journals, said upper shaft journals rotatably engaging and supporting said guide members, said shaft journals adapted to be being further fixedly attached to the inner surface of all panels of the multi-panel door except the lowermost panel;

a pair of lowermost shaft journals, said lowermost shaft journals rotatably engaging and supporting said guide members, said lowermost shaft journals adapted to being attached to the side surface of the lowermost panel of the door;

an extension member for extending said upper shaft journals away from said inner side of the door, said extension member adapted to being rigidly attached to said inner surface of the door;

a plurality of opposing guide members, said guide members adapted to be extending laterally from the side of the door, said guide members adapted to being attached to each door panel and further comprising:

a lowermost guide member adapted to being attached to the lowermost door panel and a plurality of upper guide members, said upper guide members being rotatably disposed in said upper shaft journals and projecting laterally from said side edge of said door, said lowermost guide member adapted to be projecting laterally from said side edge of said door, said lowermost guide member being disposed in said lowermost shaft journal;

a pair of pulleys adapted to be fixedly mounted adjacent to the bottom of the garage door and substantially vertically beneath said lowermost shaft journal;

a pair of lift cables having two ends, one end of said lift cables being connectedly attached to said lowermost bearing, the other end being connectedly attached to the drum, said lift cables being wound and unwound from the drums as the jackshaft operator drivingly turns the torsion bar;

a pair of reverse cables, one end of said reverse cables being connectedly attached to said lowermost bearing, the other end being connectedly attached to the drum, said reverse cables further engaging said pulleys, said reverse cables being wound and unwound from the drums as the jackshaft operator drivingly turns the torsion bar; and tracks for supporting and guiding said guide members, said tracks further comprising:

a pair of inner vertical tracks having side edges adapted to be disposed adjacent to either side of the door opening;

a pair of outer vertical tracks having an upper end, a lower end, and side edges, said side edge of said outer vertical tracks being disposed adjacent said side edge of said inner vertical tracks; and horizontal tracks having a proximal end and a distal end, said horizontal tracks adapted to be positioned above said door opening, said proximal end of said horizontal tracks being radiused downwardly to connect with the upper end of said upper end of said outer vertical tracks, said upper guide members being engaged in said outer vertical tracks when said door is in said closed position and further engaging said horizontal tracks when said door is in said open position and said lowermost guide member engaging said inner vertical tracks.

* * * * *